US006240560B1

(12) United States Patent
DeCaro

(10) Patent No.: US 6,240,560 B1
(45) Date of Patent: Jun. 5, 2001

(54) VERSATILE SWIMSUIT WITH ACCESSORIES

(76) Inventor: Linda A. DeCaro, 6146 Palm Breezes Dr., Lantana, FL (US) 33462

( * ) Notice: Subject to any disclaimer, the term of this patent is extended or adjusted under 35 U.S.C. 154(b) by 0 days.

(21) Appl. No.: 09/390,835

(22) Filed: Sep. 7, 1999

(51) Int. Cl.[7] ..... A41D 5/00
(52) U.S. Cl. ..... 2/67
(58) Field of Search ..... 2/67, 69, 1, 228, 2/238; 441/102–107, 120, 122; 450/1

(56) References Cited

U.S. PATENT DOCUMENTS

| | | | | |
|---|---|---|---|---|
| 3,306,299 | * | 2/1967 | Paramore | 450/1 |
| 3,311,112 | * | 3/1967 | Murray | 450/86 |
| 3,654,630 | * | 4/1972 | Block | 2/67 |
| 3,771,172 | * | 11/1973 | Barg | 2/67 |
| 3,774,241 | * | 11/1973 | Zerkle | 2/67 |
| 3,939,845 | * | 2/1976 | Guidoni | 450/1 |
| 4,028,740 | * | 6/1977 | Luerken | 2/67 |
| 4,031,900 | * | 6/1977 | Guidoni | 450/69 |
| 4,656,669 | * | 4/1987 | Beard | 2/67 |
| 4,815,145 | * | 3/1989 | Chow | 2/67 |
| 4,917,651 | * | 4/1990 | Rainville | 450/58 |
| 5,032,104 | * | 7/1991 | Rainville | 450/58 |
| 5,538,502 | * | 7/1996 | Johnstone | 602/79 |
| 5,987,650 | * | 11/1999 | Carroll | 2/244 |
| 5,991,920 | * | 11/1999 | Holland | 2/67 |
| 6,055,668 | * | 5/2000 | Gros et al. | 2/69 |

* cited by examiner

*Primary Examiner*—Gloria M. Hale
(74) *Attorney, Agent, or Firm*—Robert M. Downey, P.A.

(57) ABSTRACT

A swimsuit is provided with a plurality of loop members and hook and loop fasteners for interchangeable attachment of straps, linked chains, and other accessories in a manner which alters the style and appearance of the swimsuit. The straps, linked chains, or the like are selectively attachable to the loops on a woman's swimsuit top to achieve various angles of lift so that the breasts are either moved closer together or separated, as desired by the wearer. The straps or linked chains are also attachable to loops on the swimsuit top and bottom to adjustably fit and secure the swimsuit top and bottom on the wearer. One or more closeable band wraps can be wrapped about the swimsuit top and/or bottom to achieve different swimsuit styles including a conventional style, a Brazilian cut or a thong. The hook and loop fasteners provide removable and interchangeable attachment of accessories including a mid-section between the top and bottom of a woman's swimsuit, a skirt, a full length gown, a sash, fabric panels including race numbers, or other accessories desired by the user.

29 Claims, 10 Drawing Sheets

10
20
30
37
64
36

20'
70

22
60

44
46
46'
62

VERSATILE SWIMSUIT WITH ACCESSORIES

BACKGROUND OF THE INVENTION

1. Field of the Invention

The present invention relates to a swimsuit with interchangeable accessories and, more particularly, to a swimsuit including a plurality of loops and hook and loop fastening means for interchangeable attachment of elongate strips (straps), linked chains or other accessories thereto in order to provide a variety of styles, appearances and adjustable fitting of the swimsuit to the wearer's body.

2. Description of the Related Art

Men's and women's swimsuits are available in a variety of styles ranging from conservative and conventional looks to more exotic and risque fashions. Generally, each style swimsuit has a particular cut which fits differently on each person's body, depending on the person's overall physique. In many instances, a person will buy a swimsuit, after trying it on briefly in the store, because they are attracted to the particular style of the suit. However, once they wear the swimsuit, which may be several months later, they sometimes feel uncomfortable with the fit because the swimsuit doesn't compliment their physical features. This may be due to a change in the person's weight or physical condition since purchasing the swimsuit. Otherwise, it may be that the swimsuit style, size and cut is simply not right for that person's body type. Unfortunately, most stores will not allow a swimsuit to be returned once it has been purchased. Further, it is usually not possible to alter the fit of the swimsuit so that it conforms more properly to the person's physical features.

Another concern, particularly of women, is the need to have several swimsuits, preferably of a different appearance, so that the person does not have to wear the same swimsuit each day. This is a particular concern when vacationing at a resort or on a cruise ship wherein the wearer of the swimsuit may be seen by the same people every day for a week or more. However, considering the time and expense involved in shopping for more than one swimsuit, it is not surprising that most people do not maintain a selection of swim wear in their wardrobe.

Accordingly, there is an urgent need for a versatile, all-in-one swimsuit which allows the wearer to adjustably fit the swimsuit to their body and which further allows for selective positioning and attachment of straps, linked chains, band wraps, and other accessories to alter the cut, style, fit and appearance of the swimsuit, thereby providing a plurality of swimsuit styles, with adjustable fitting, all in one swimsuit.

SUMMARY OF THE INVENTION

The present invention is directed to a versatile swimsuit which incorporates a plurality of loop members at strategic locations to facilitate interchangeable attachment and adjustable positioning of straps, linked chains, ties, or like articles to secure and adjustably fit the swimsuit to the wearer's body. The straps, linked chains, or the like may be attached to different ones of the loop members on the swimsuit according to the fit and style desired by the wearer. The swimsuit further uses hook and loop fasteners for removable and interchangeable attachment of various accessories to the swimsuit.

In one embodiment, a woman's bikini-style swimsuit includes a top and a separate bottom. The lower edge of the bikini top, along an inside of the cups, is provided with a strip of loop component material (i.e., the soft component) of a hook and loop fastening system. Similarly, the top front edge, along the inside of the swimsuit bottom, is provided with a strip of the loop component material. Various accessories are provided with the hook component of the hook and loop fastening system to facilitate removable attachment of the accessories to the swimsuit and/or bottom. In particular, a skirt is attachable to the swimsuit bottom along the top inner edge of the swimsuit bottom, using the hook and loop fasteners, so that the skirt surrounds the wearer's body and hangs downwardly in covering relation to the swimsuit bottom and legs of the wearer. In another embodiment, a gown is attachable to the lower inside edge of the swimsuit top, so that the gown surrounds the wearer's body from the lower edge of the swimsuit top, to the legs or ankles. Another accessory is a mid panel which attaches between the lower inside edge of the swimsuit top and the top inside front edge of the swimsuit bottom, extending therebetween and covering the stomach of the wearer, thereby giving the appearance of a one piece style swimsuit. The invention further includes a sash which attaches to the swimsuit top and extends across the breasts and about the back of the wearer, in covering relation to the swimsuit top. The sash can be used in conjunction with the gown to achieve a formal appearance.

The invention further includes band wraps which are structured to be removably wrapped about various areas of the swimsuit in order to gather the material within the grasp of the band wrap, thereby altering the cut of the swimsuit while also providing a decorative enhancement. Specifically, one or more band wraps may be fitted to a bikini bottom to alter the cut of the bikini bottom from a conventional style to a Brazilian cut style or, alternatively, a thong. The band wraps may further be used on a bikini top, between the cups, to alter or enhance the appearance of the bikini top.

In another embodiment, for both a man's or woman's swimsuit, means are provided for removable attachment of a fabric panel to the swimsuit bottom. Specifically, the fabric panel may include a number or other indicia thereon, such as a participant's number in a race (e.g., a marathon, triathlon, etc.).

In still another embodiment, a loop is releasably attachable to the swimsuit bottom for hanging articles on the loop, such as keys, a shirt, a hat, etc.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
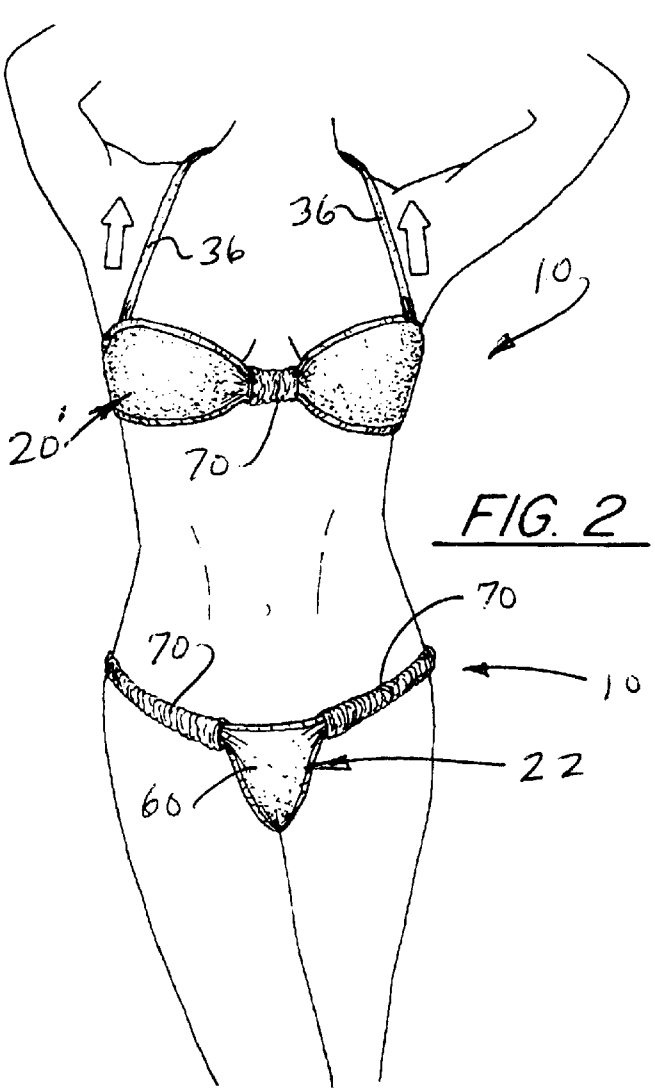
FIG. 2 is a front perspective view showing a bikini-style swimsuit of the present invention on a wearer with straps and band wraps attached to the swimsuit, in accordance with one desired style, fit and cut, selected by the wearer.
Figure 3:
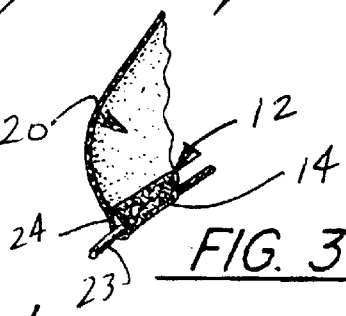
FIG. 3 is an isolated view, in partial section, taken along the line 3—3 of FIG.
Figure 1:
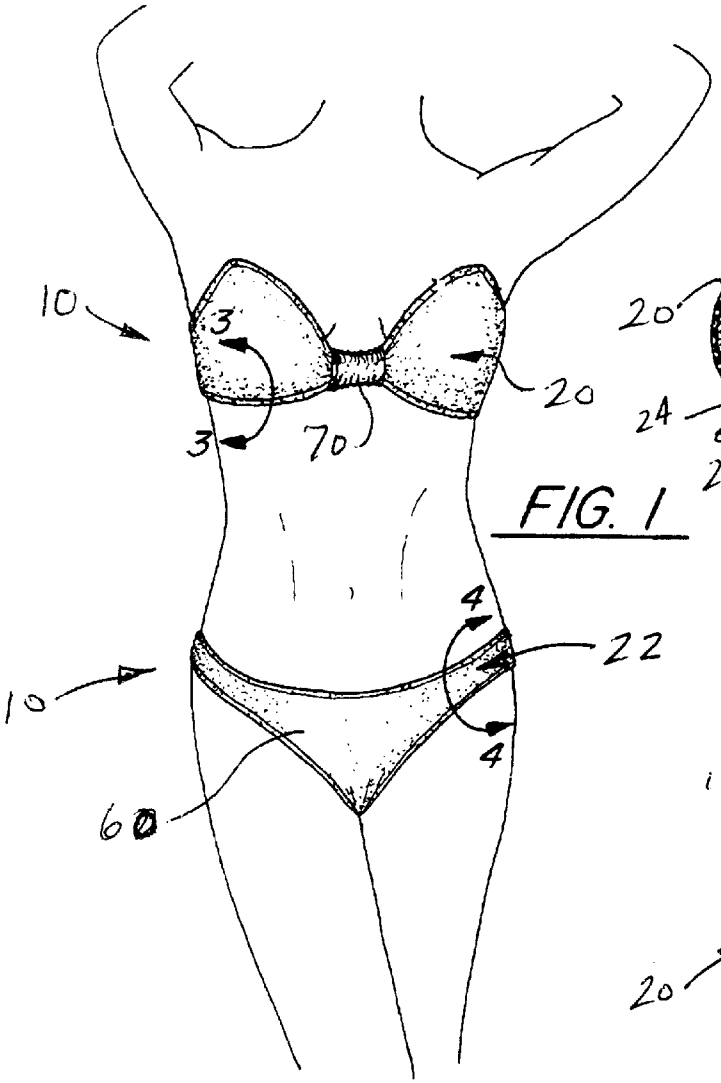
FIG. 1 is a front perspective view, showing a bikini-style swimsuit of the present invention on a wearer.

Referring to the several views of the drawings, and initially to FIGS. 1–3, the swimsuit of the present invention is shown in accordance with various embodiments thereof and is generally indicated as 10 throughout the several views of the drawings. In each of the embodiments, the swimsuit is provided with VELCRO (hook and loop fastening means) 12, including a loop material component 14 and a hook material component 16, to facilitate attachment of various accessories to the swimsuit.

Figure 4:
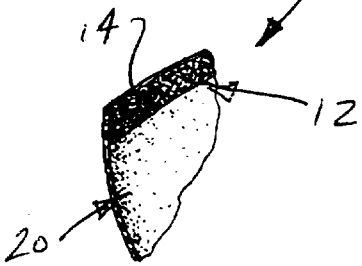
FIG. 4 is an isolated view, in partial section, taken along the line 4–4 of FIG. 1.
Figures 5, 6A, 6B, 7:
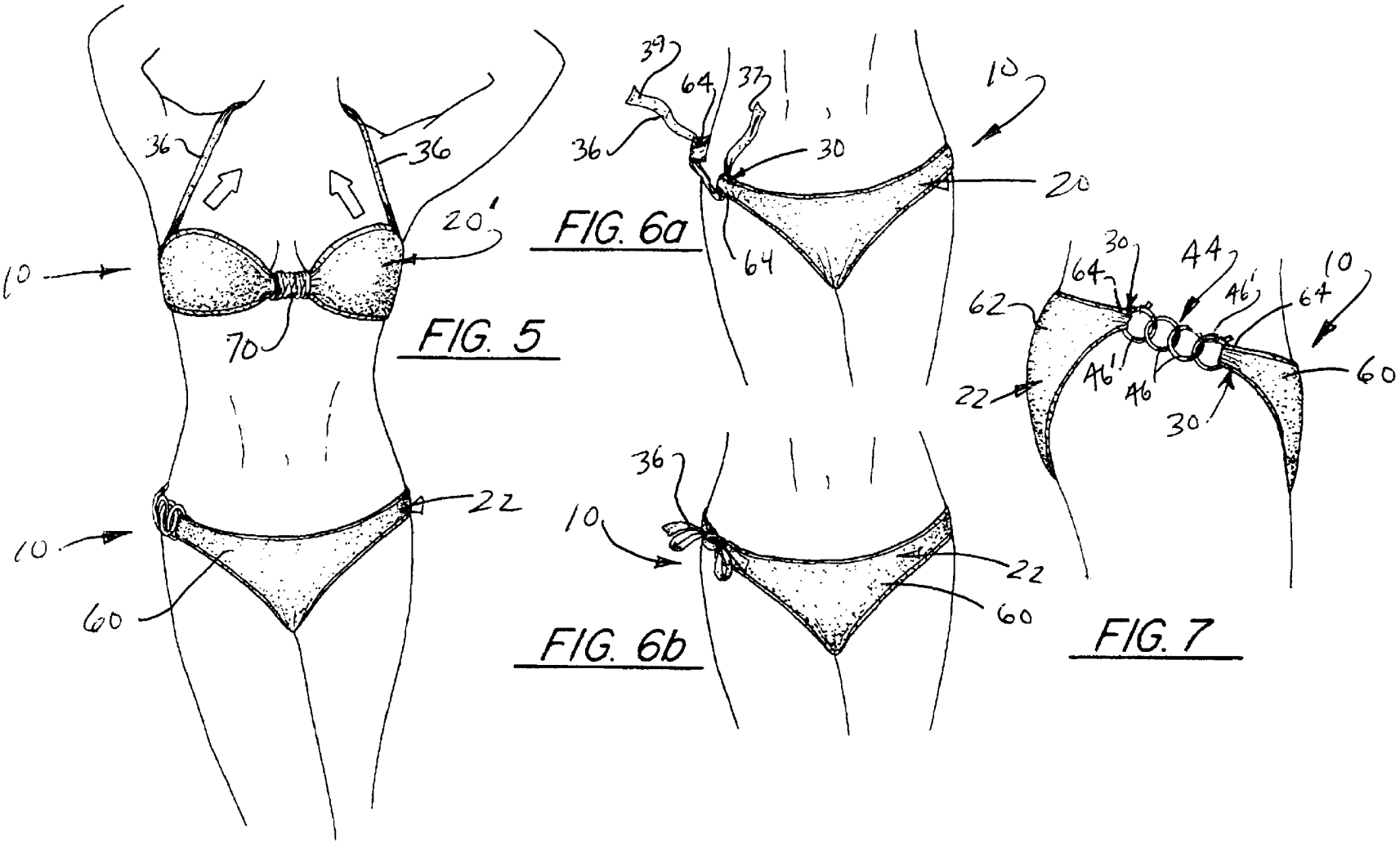
FIG. 5 is a front perspective view of a bikini swimsuit of the present invention, showing straps and a band wrap on the swimsuit top and a linked chain on the swimsuit bottom, in accordance with a selected style, fit and cut selected by the wearer.
FIGS. 6A and 6B are isolated perspective views showing a bikini bottom being secured to the wearer's body with an elongate tie strap fitted through opposing loop members on the front and rear panels of the bikini bottom.
FIG. 7 is an isolated, side elevational view, showing a linked chain fitted through the opposing loop portions on the front and rear portions of the bikini bottom for securing the bikini bottom to the wearer's body.

In the various embodiments shown in FIGS. 1–24, the swimsuit is provided in the form of a bikini having a top 20 and a bottom 22. The top 20 may be provided in various styles such as a triangular cup style, seen in FIGS. 1, 10 and 11B. Alternatively, the bikini top 20 may be in the form a bando style as best seen in FIGS. 2, 5 and 13. In each of these embodiments, the bikini top is provided with hook and loop fastening means 12, and specifically the loop material component 14, along the lower inside edge, below the cups. The softer component (i.e., the loop material) of the hook and loop fastening means is stitched along the lower inner edge of the bikini top (see FIG. 3), as well as the top, inside edge of the bikini bottom (see FIG. 4). The hook counterpart material 16 of the hook and loop fastening means is provided on the various accessories which attach to the bikini top and bottom.

Figures 8A, 8B, 8C, 9A, 9B:
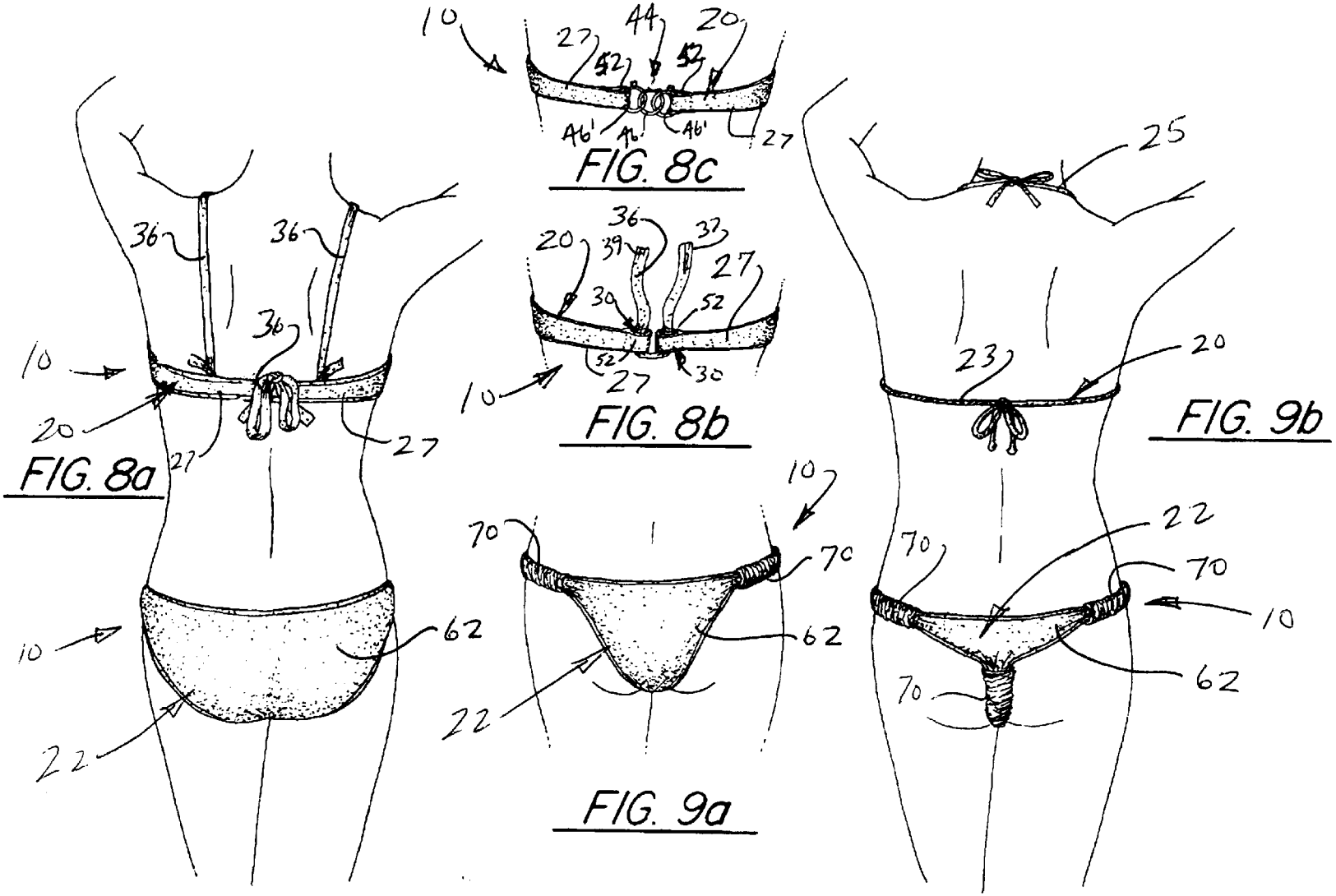
FIG. 8A is a rear perspective view showing a bikini swimsuit, in accordance with one embodiment of the invention, with straps and a tie secured to loops on the bikini top to achieve a desired, adjusted fit, style and appearance.
FIG. 8B is an isolated perspective view showing opposing loop members on the back straps of a bikini top, in accordance with one embodiment of the invention, with an elongate tie strap received through the opposing loop members to adjustably secure the bikini top about the wearer's body.
FIG. 8C is an isolated perspective view showing the back strap of the bikini top of FIG. 8B being secured with an adjustably sized linked chain secured to the opposing loop members on the back straps of the bikini top, to thereby adjustably secure the bikini top about the wearer's body.
FIG. 9A is an isolated, rear perspective view showing the band wraps fitted to a bikini bottom, to thereby alter the cut and style of the bikini bottom from a conventional style to a Brazilian cut.
FIG. 9B is a rear perspective view of a bikini swimsuit on a wearer with the band wraps of the present invention shown fitted to the bikini bottom to alter the cut and style of the bikini bottom from a conventional style to a thong style.
Figure 10:
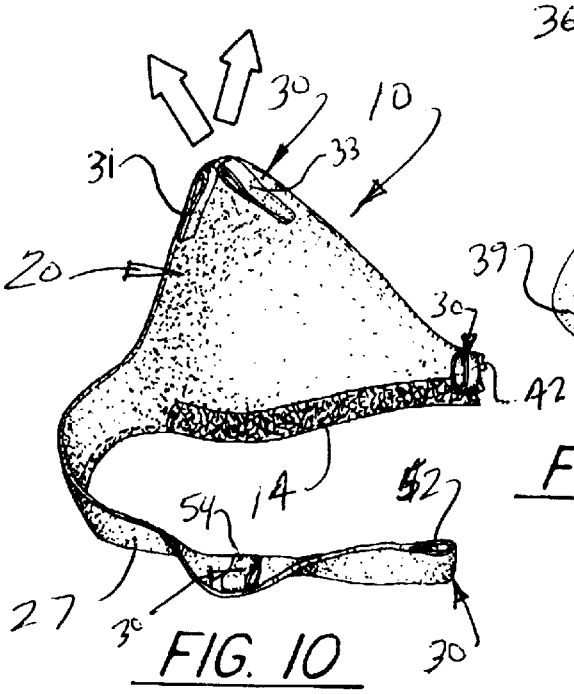
FIG. 10 is an isolated, rear perspective view of a triangular style bikini top with a plurality of loop members strategically located at several locations on the inner facing side of the bikini top, in accordance with one preferred embodiment of the invention.

In the embodiment shown in FIG. 1, the bikini top 20 includes a string 23 which travels through a sleeve 24 formed along the lower edge, for tying the bikini top around the wearer's back, as seen in FIG. 9B. A string 25 may also be extended from the upper portion of the cups to further secure the bikini top about the back of the wearer's neck, as seen in FIG. 9B. In another embodiment, as seen in FIG. 10, the bikini top may include back straps 27 extending from the sides of the cup for securing the bikini top about the wearer's body, on the back, as seen in FIGS. 8A–8C.

Figure 11A:
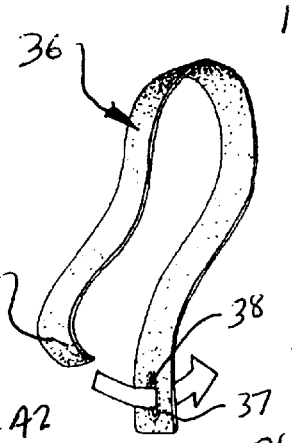
FIG. 11A is an isolated perspective view illustrating a feed through strap used in conjunction with the swimsuit to secure the swimsuit to the wearer's body in accordance with a desired adjusted fit, style and appearance.
Figure 11B:
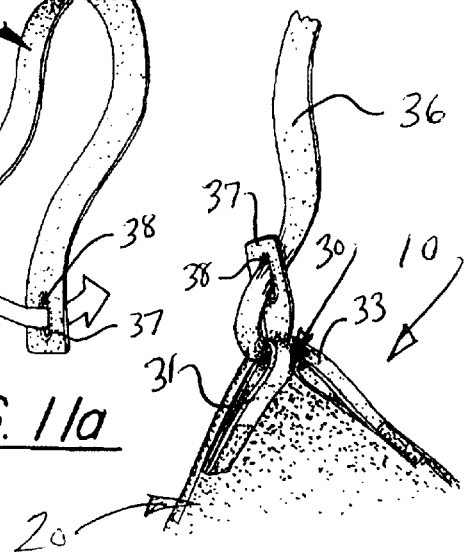
FIG. 11B is an isolated perspective view showing the feed-through strap secured to one of the loop members of the bikini top of FIG. 10, for providing a shoulder strap to secure the bikini top in accordance with a desired fit, style and appearance.

In each of the embodiments of the invention, the swimsuit is provided with a plurality of loop members 30 which are strategically placed at various areas on the swimsuit to facilitate attachment of elongate securing members such as straps, linked chains, elongate strips, strings, or the like. In the various embodiments directed to a woman's two-piece (e.g., bikini), the swimsuit top is provided with several of the loop members. Specifically, each of the cups of the swimsuit is provided with a pair of loop members, including a first loop member 31 and a second loop member 33. On the triangular style cup, the loop members are positioned on opposing sides of the apex of the cup, on the inner facing surface, as best seen in FIG. 10. These loop members are specifically intended for attachment of the elongate securing members, such as the flexible strap 36 shown in FIGS. 11A and 11B. Depending upon which loop member the strap 36 is secured to, a different fit and lift of the breasts is achieved. Specifically, securing the strap 36 to the first loop member 31, as seen in FIG. 11B, will cause the cup, and accordingly the breasts, to be lifted upwardly and inwardly so that the breasts are pulled slightly together while also being lifted. Securing the strap 36 to the second loop member 33, on each of the cups, will result in the breasts being lifted and slightly separated from one another. Alternatively, the strap 36 may be secured about both the first and second loop members 31 and 33 of each cup to lift the breasts directly upward. In accordance with the preferred embodiment, the strap 36 is formed of a flexible, fabric material, which may be the same as the swimsuit material, in a matching color or contrasting color. The flexible strap (i.e., fabric strip) includes a first end zone 37 having a slot 38 formed therein. An opposite distal end 39 of the strap is received through the slot 38 to form a loop which is secured to the selected loop member(s) 30 of the swimsuit, in the manner shown in FIG. 11B.

In the embodiment directed to the bando style bikini top 20', as seen in FIGS. 2, 5 and 13, the first and second loop members 31 and 33 are provided along the outer periphery of the cup, on the inner surface, with the first loop member 31 disposed above the second loop member 33. In use, the strap 36 is secured to either one of the first or second loop members 31 or 33 and tied behind the neck, as seen in FIGS. 2 and 5. Securing the strap to the first loop member 31 of each cup will result in the breasts being lifted in the direction of the arrows shown alongside the straps in FIG. 2. Alternatively, securing the straps 36 to the second loop members 33 of each of the cups, will result in the breasts being lifted and pulled slightly together, in the direction of the arrows shown in FIG. 5.

It is further noted that the swimsuit top is provided with an elastic material 40, between an outer layer material and an inner liner of the swimsuit top 20, 20', along the outer sides and lower periphery of the cups, extending from the loop members 31, 33 on one cup, to the loop members on the other cup. The cups may be further adjustably separated and secured with loop members 42 on the inboard portion. In this particular embodiment, the cups are secured to one another, between the breasts, using the flexible strap 36 of FIG. 11A, or alternatively, a linked chain 44 of the type seen in FIG. 7 and 8C, which uses a plurality of ring members 46, 46' linked together. The outermost ring members 46' include a clasp to facilitate attachment of the rings to the loop members 42 on the swimsuit. The back strap 27 of the bikini top may further be provided with loop members 53 at the distal ends of the strap, as best seen in FIGS. 8A–8C, 10 and 13. With the opposite back straps 27 pulled around the wearer's back, as seen in FIGS. 8B and 8C, the back straps 27 may be secured with the use of the flexible strap 36 of FIG. 11A or, alternatively, the linked chain 44 shown in FIG. 8C. Other flexible, removable securing members may be used as well. In either of the examples shown in FIG. 8B or 8C, the distance between the distal ends of the back straps may be adjustably secured to accommodate for various size wearers. Specifically, the flexible tie strap 36 is pulled until the back straps 27 are secure, but not too tight, and then the flexible tie strap 36 is secured in a bow, as seen in FIG. 8A. Alternatively, in the embodiment using the linked chain 44, the opposite end links 46' (rings) include clasp members to facilitate removable attachment of the rings to the loop members 52 on the distal ends of the back straps 27. Additional rings 46 may be fitted between the opposite end rings 46' to adjust the length of the linked chain 44, and thereby adjusting the separation of the looped distal ends 52 of the back straps 27, to accommodate for different size individuals.

The back straps 27 of the bikini tops, in each of the embodiments, may further be provided with loop members 54 spaced from the looped distal ends 52 of the strap, so that the loop members 54 are positioned generally below the shoulder blades of the wearer, when the back straps 27 are secured, as seen in FIGS. 8A and 10. The loop member 54 on the back strap is specifically structured and intended for securing of the flexible tie straps 36 extending from the loop members 31 and/or 33 on the cups of the front of the swimsuit top and over the shoulders. Specifically, the strap member may be secured to one or both of the loop members on the cup 31, 33, as seen in FIG. 11B, and extended over the shoulders for attachment to the loop member 54 on the back strap 27. The strap 36 may be secured to the loop member 54 by feeding the strap 36 through the loop member 54 and securing the strap in a knot. Alternatively, the strap 36 may be secured to the loop member 54 on the back strap 27 with a slip through loop formed using the slot 38, as seen in FIGS. 1A and 1B, so that the opposite end 39 of the strap is tied in a knot on the loop members 31, 33 adjacent the cups, on the front of the swimsuit. Again, depending on which of the first or second loop members 31, 33 the strap is secured to, a different fit and lift of the breasts may be achieved.

The strap members 36 or linked chain 44 may further be used to secure the front 60 and rear 62 panels of the bikini bottom 22 to the wearer. Specifically, as seen in FIGS. 6A–7, the upper, outer ends of the front and rear panels of the bikini bottom are provided with loop members 64 for receipt of the flexible strap 36 or rings 46, 46' of the chain 44 therethrough. Again, the link chain 44 includes end rings 46' having a clasp which opens to facilitate passage of the rings through the loop members 64 on the swimsuit, as seen in FIG. 7. Additional rings 46 may be added between the opposite end rings to adjust the length of the securing linked chain, and thereby the separation between the loop members 64 on the front and rear panels 60, 62 of the swimsuit, to accommodate for the size of the individual wearer. Likewise, the flexible strap member 36 can be adjustably secured, and tied into a knot or bow, as seen in FIG. 6B, in a manner which adjusts the separation of the loop members 64 on the front and rear panels 60, 62 to accommodate for the size of the individual wearer. The bikini bottom 22 may be provided with the opposing loop members 64, on the front and rear panels, on one side of the wearer, as seen in FIGS. 6A and 6B, or alternatively, on both sides of the wearer.

Referring to FIGS. 1, 2, 9A, 9B and 12, a further feature of the invention is a band wrap 70 formed of a flexible material, which may include elastic between opposing inner and outer fabric panels. The band wrap 70 further includes hook and loop fastening means 72 on opposing edges 74, 76 so that the band wrap can be rolled in a tubular shape and secured along the opposing edges 74, 76, in the manner shown in FIG. 12. The band wrap 70 is specifically to be wrapped about the swimsuit, at selected areas, to adjust the cut and/or fit of the swimsuit as well as to enhance the appearance of the swimsuit. Specifically, the band wrap 70 may be secured between the cups of the bikini top 20, 20', as seen in FIGS. 1 and 2, providing a decorative accessory to the swimsuit and thereby enhancing the appearance. Additionally, the band wrap may be used on the bikini bottom 22. Specifically, two or more band wraps 70 may be secured at various areas on the bikini bottom 22 to alter the cut, style and appearance of the bikini bottom of the swimsuit. In FIG. 9A, two or more band wraps 70 are secured on the sides of the swimsuit, along the hips of the wearer, causing the rear panel 62 of the bikini bottom to be pulled upwardly into a generally triangular shape resembling a Brazilian style cut. By moving the band wraps on either side, towards one another, or separating them, the degree of the cut of the rear panel, may be altered. Specifically, separating the band wraps will enlarge the rear panel 62, to thereby cover a larger area of the buttocks. Moving the band wraps 70 closer together will result in a reduction in size of the rear panel 62, with a more dramatic cut, thereby exposing more of the buttocks. Similarly, the band wraps 70 may be secured on opposing sides of the front panel 60 of the bikini bottom 22, as seen in FIG. 2, to alter the size and cut of the front panel 60. Again, moving the band wraps 70 closer together, towards the center of the wearer, will result in the front panel 60 being reduced in size, while separating the band wraps from each other will enlarge the front panel 60 of the swimsuit.

Additional band wraps 70 may be secured to the rear panel 62, in the manner shown in FIG. 9B, to gather the material of the rear panel in a manner which exposes more of the wearer's buttocks, resembling a thong style swimsuit.

Figure 12:
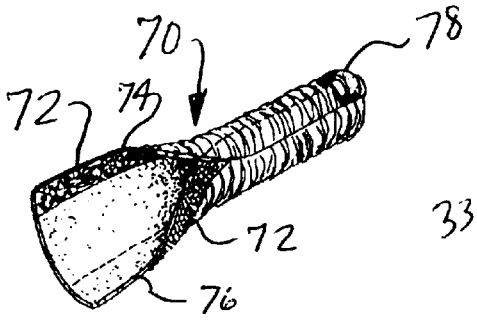
FIG. 12 is an isolated perspective view showing the band wrap of the present invention.
Figure 13:
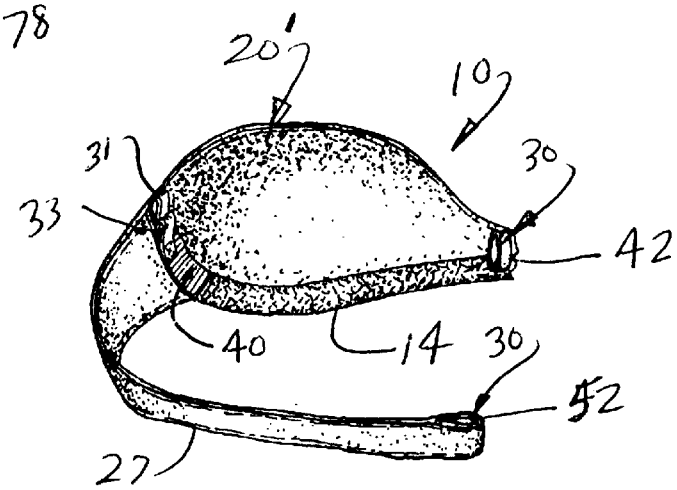
FIG. 13 is an isolated perspective view, in partial cutaway, showing yet another embodiment of a bando style bikini top with the loop members fitted at strategic locations on an inner facing side of the bikini top.
Figure 14:
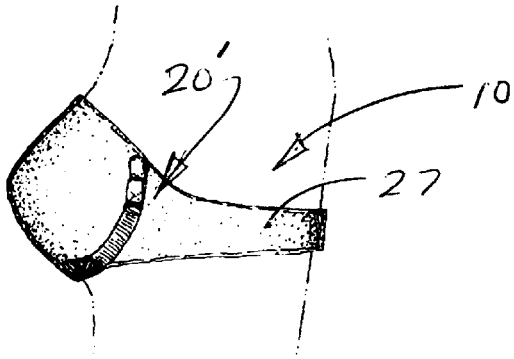
FIG. 14 is a side elevational view showing the bikini top of the present invention positioned on the wearer's body.

It should be further noted that the band wraps 70 are provided with loop members 78, as seen in FIG. 12, to facilitate attachment of accessories, including the straps, linked chains, or other accessories. For instance, a beaded strand of jewelry (e.g., a strand of pearls, gemstones, or the like) may be secured to the loop members 78 of two of the band wraps, so as to extend the beaded strand across the front or rear panel of the swimsuit, thereby enhancing the appearance of the swimsuit.

Loop members 79 may be provided on the upper front inner edge of the swimsuit bottom 22 to facilitate attachment of accessories thereto, such as a chain or beaded strand of jewelry attached at opposite ends to the spaced loop members 79 so that the chain or jewelry strand is draped on an outside of the front panel 60 to thereby provide an enhanced decorative appearance.

Figure 15:
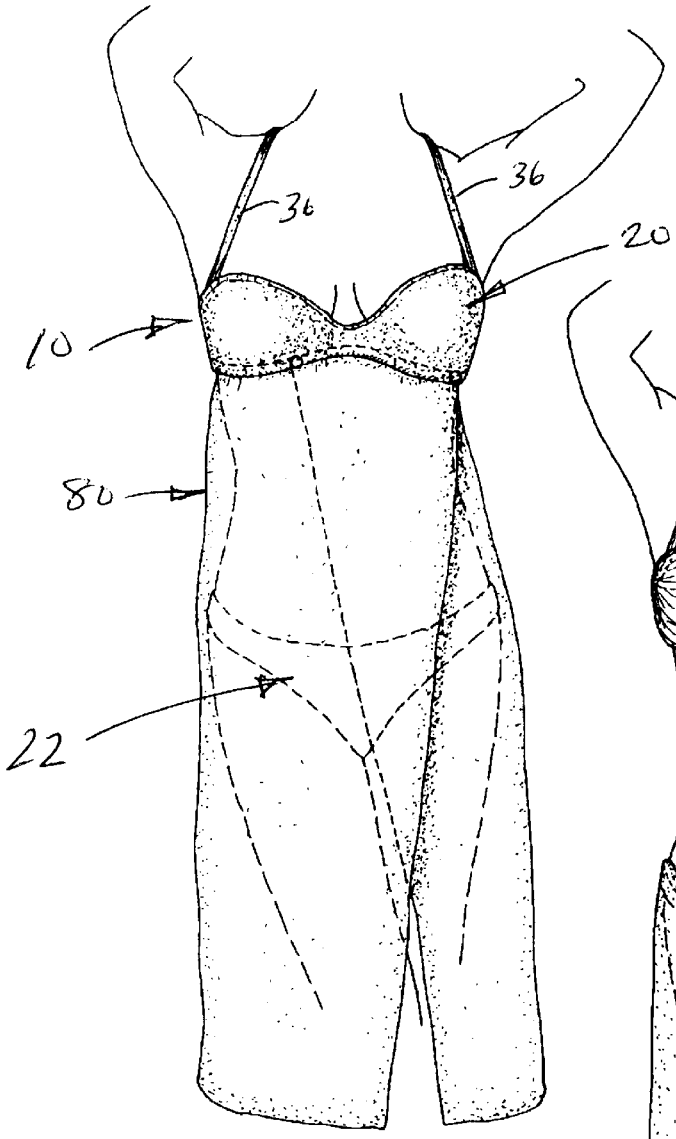
FIG. 15 is a front perspective view showing a gown secured to a bikini swimsuit top in accordance with yet another embodiment of the invention.

The hook and loop fastening means 12 of the top and bottom of the swimsuit are structured and disposed to facilitate attachment of various accessories thereto. For instance, as seen in FIGS. 15–18, various garments may be secured to the swimsuit top 20, 20' and/or bottom 22. Specifically, a gown 80 may be secured to the lower inner edge of the swimsuit top, as seen in FIG. 15, so that the gown drapes down in covering relation to the wearer's body, resembling an evening gown.

Figure 16:
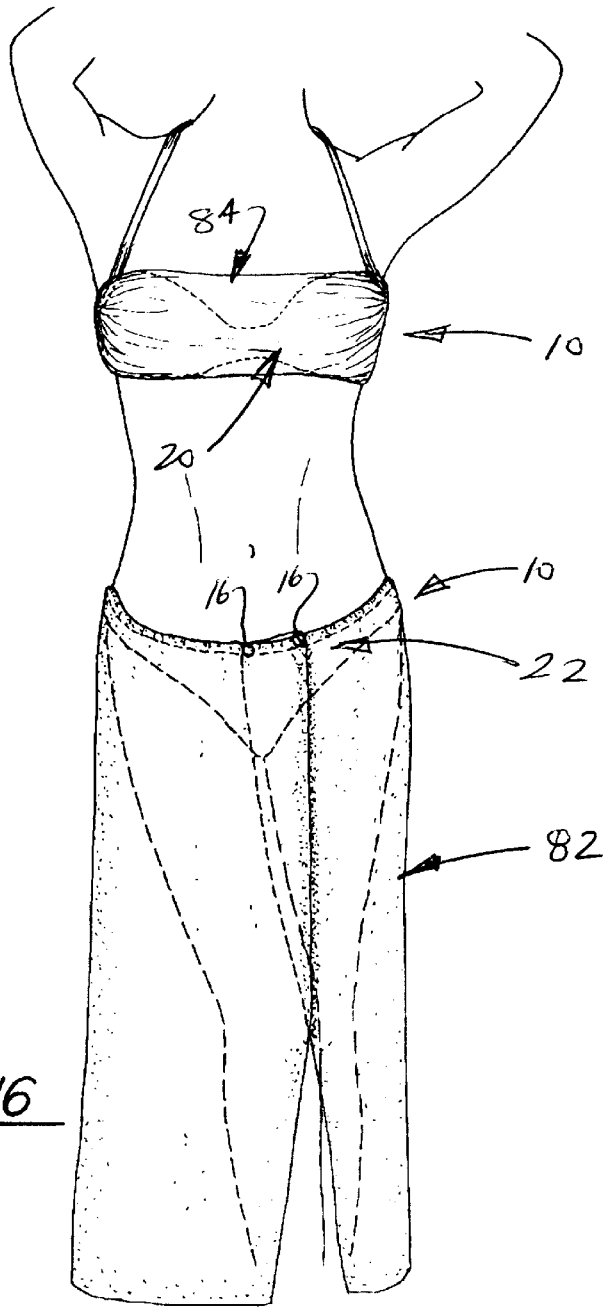
FIG. 16 is a front perspective view showing a sash and skirt fitted to the bikini swimsuit in yet another embodiment of the present invention.
Figure 17:
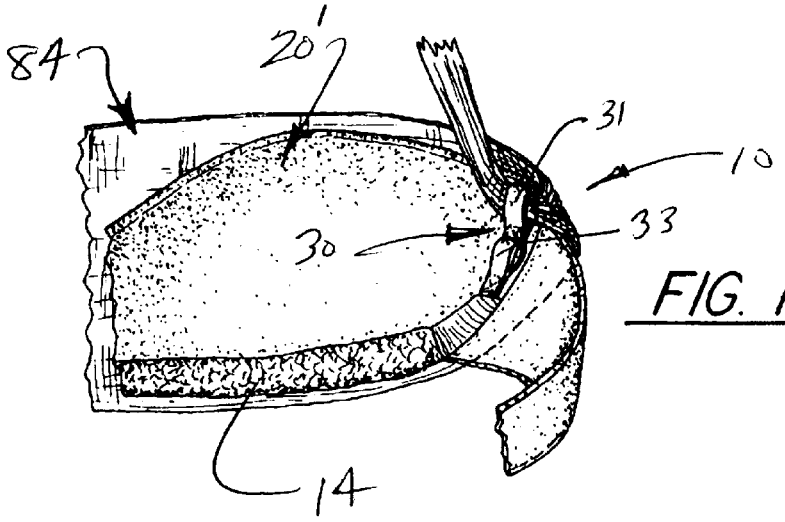
FIG. 17 is an isolated, perspective view, in partial cutaway, showing attachment of the sash to one of the loop members of the bikini top.
Figure 18:
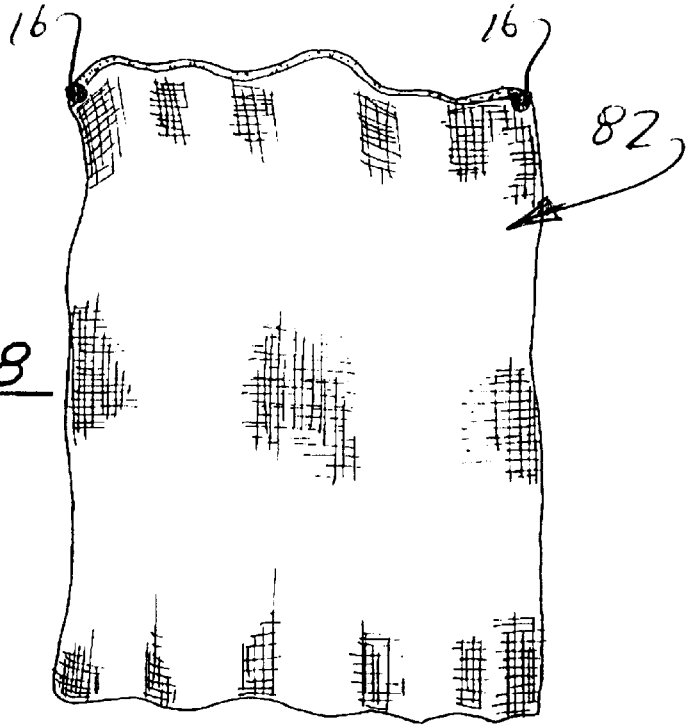
FIG. 18 is a perspective view of the skirt of FIG. 16 shown removed from the swimsuit.

In another embodiment, a skirt 82 may be attached to the upper, inner edge of the swimsuit bottom, in the manner as shown in FIG. 16. In either of these embodiments, the skirt or gown is provided with patches of the hook component 16 of the hook and loop fastening means, for releasable attachment to the loop component 14 along the inner edges of the swimsuit top and bottom, as explained above. A sash 84 may further be attached to the swimsuit top and extended across the front of the wearer, as seen in FIG. 16 to provide a more formal appearance when used in conjunction with either the skirt 82 or gown 80. The sash 84 is secured to the bikini top 20, 20' by feeding a corner of the sash through one of the loop members 31, 33 on each of the cups, in the manner shown in FIG. 17. Once the corner is fed through the loop member, it may be secured in a knot or pulled tight and tucked under the back strap 27 or cup of the swimsuit, holding the sash across the breasts in the manner as shown in FIG. 16.

Figures 19, 20, 21, 22:
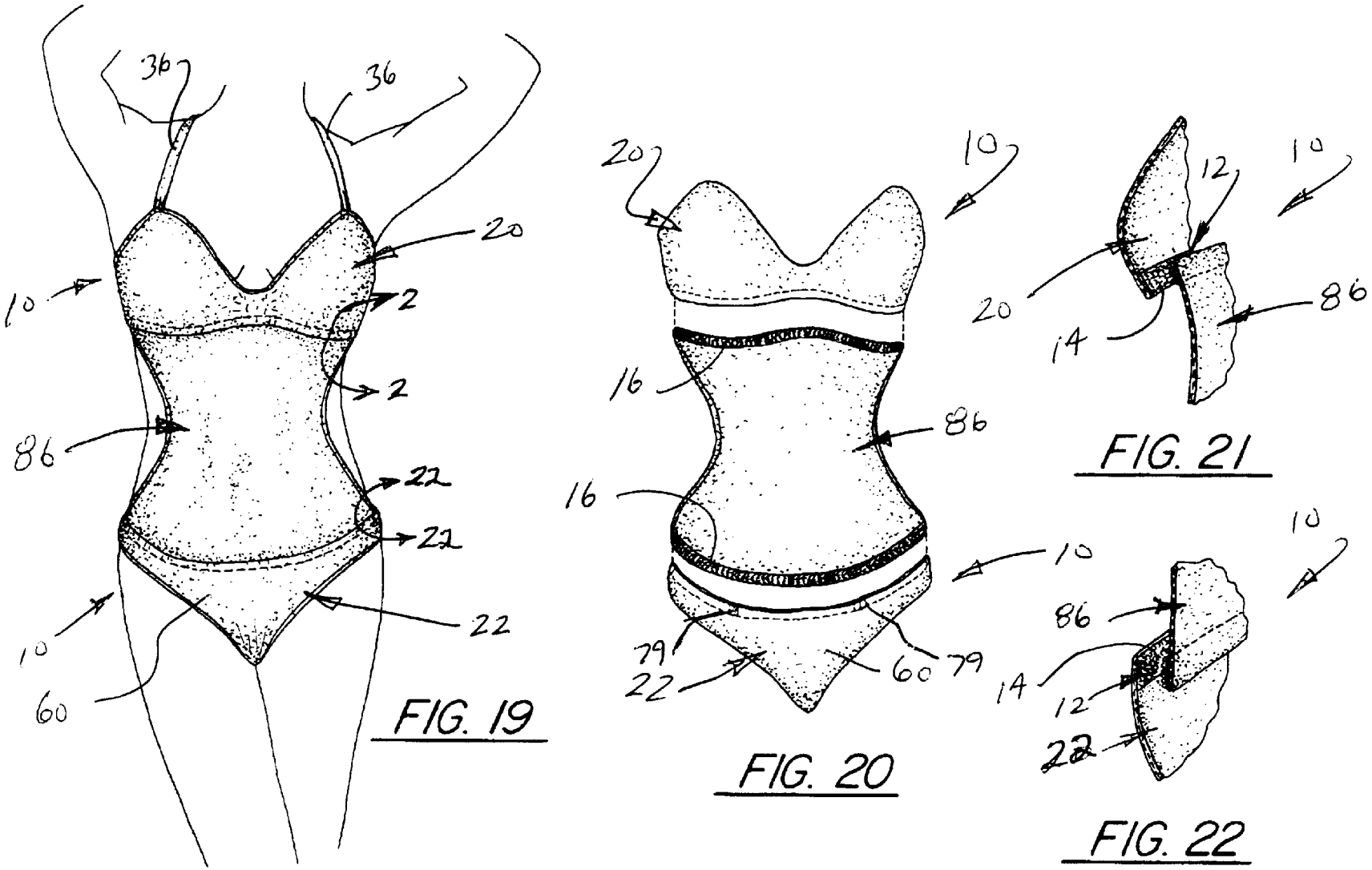
FIG. 19 is a front perspective view showing a mid panel accessory attached to the bikini top and bottom, and extending therebetween to thereby cover the wearer's stomach in still another embodiment of the invention.
FIG. 20 is an isolated perspective view showing the mid panel section separated from the bikini top and bottom.
FIG. 21 is an isolated, perspective view, in partial section, taken along the line 21—21 of FIG. 19.
FIG. 22 is an isolated, perspective view, in partial section, taken along the line 22—22 of FIG. 19.

In another embodiment, a mid panel 86 is provided for attachment between the bikini top 20, 20' and bottom 22. Specifically, the mid panel 86 includes upper and lower edges fitted with the hook component 16 of the hook and loop fastening means 12 for releasable attachment with the loop component 14 on the inner edges of the swimsuit top 20, 20' and bottom 22, as seen in FIGS. 19–22. Specifically, the upper edge of the mid panel 86 is releasably secured to the lower, inner edge of the swimsuit top 20, as seen in FIG. 22. Further, the lower edge of the mid panel 86 is secured to the inner, upper edge of the bikini bottom 22, as seen in FIG. 21. When attached between the bikini top and bottom, the mid panel 86 covers the stomach of the wearer, as seen in FIG. 19, to alter the style of the swimsuit from a bikini to a one piece style.

Figure 24:
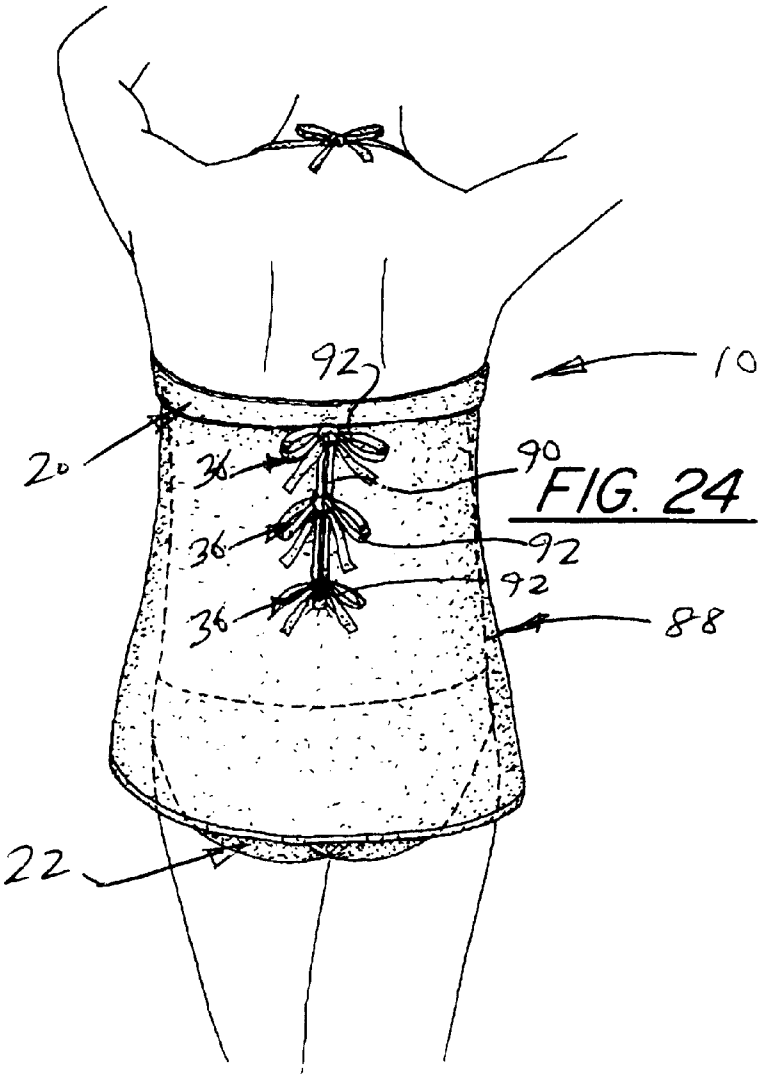
FIG. 24 is a rear perspective view showing the maternity gown fitted to the bikini top on the wearer, with removable straps tied in bows along a vertical slit to enhance the appearance of the maternity outfit.
Figure 23:
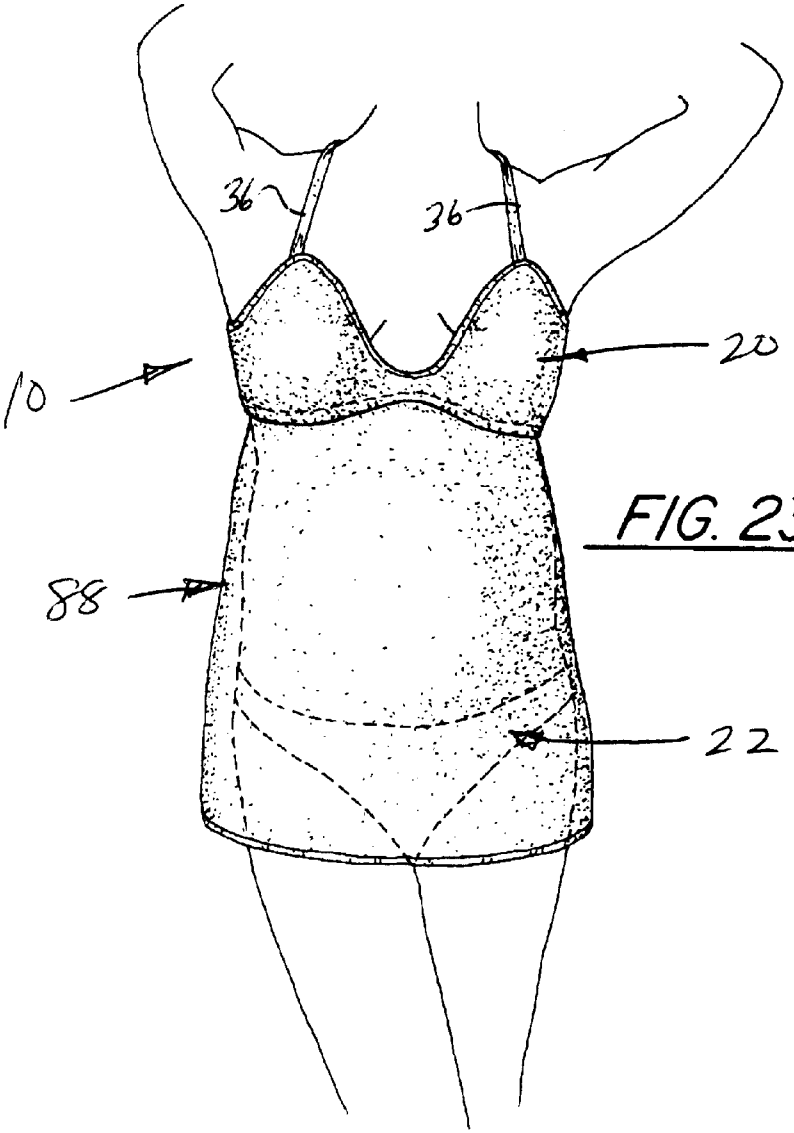
FIG. 23 is a front perspective view showing a maternity gown fitted to the bikini top in yet another embodiment of the invention.
Figure 25:
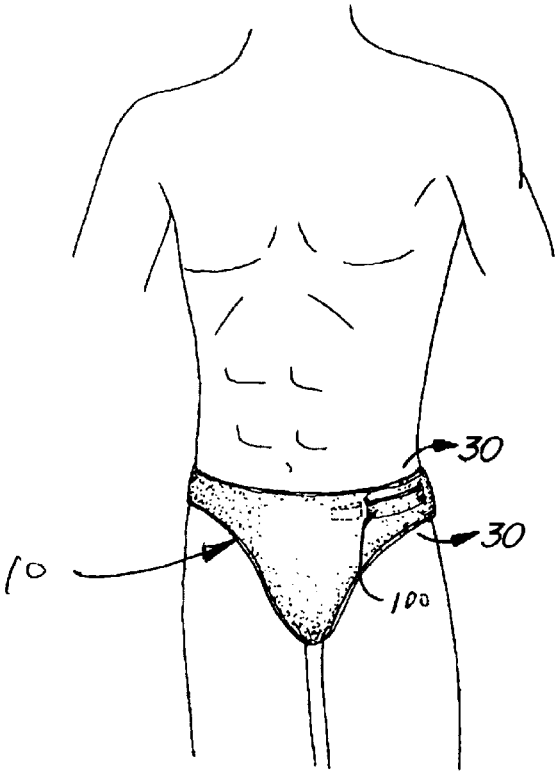
FIG. 25 is a front perspective view of a man's bikini style swimsuit showing a loop member fitted thereto in accordance with yet another embodiment of the invention.

In still a further embodiment of the invention, a maternity gown 88 may be secured to the bikini top 20, 20', with the hook and loop fastening means 12, along the top inner edge of the bikini top, in a manner shown in FIGS. 23 and 24. The back of the gown 88 may be provided with an elongate slit 90 with eyelets or holes on opposite sides to facilitate tying of bows 92, as seen in FIG. 24. Specifically, the straps 36 shown in FIG. 11A, may be passed through the eyelets, on opposite sides of the slits 90, and tied into a bow 92, to facilitate adjustment of the size to the wearer and to enhance the appearance of the maternity gown.

Figure 26:
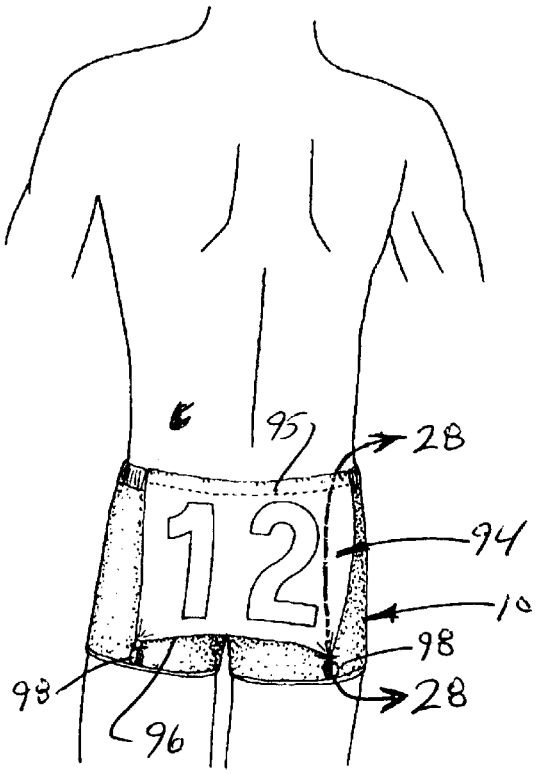
FIG. 26 is a rear perspective view of a man's trunk style swimsuit with a race participant's number secured to the swimsuit in accordance with yet another embodiment of the invention.
Figure 27:
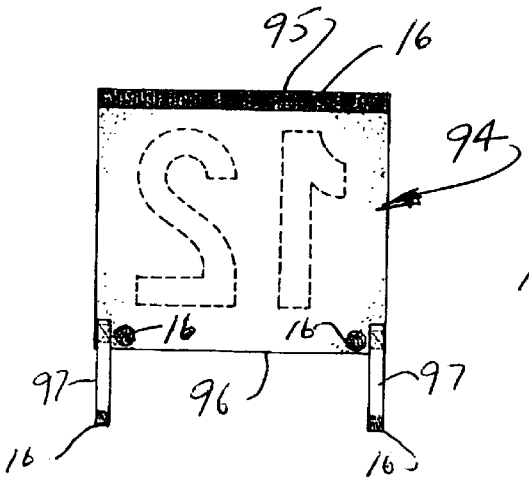
FIG. 27 is a rear plan view of the race participant's number attachment accessory in accordance with the embodiment of FIG. 26.
Figure 28:
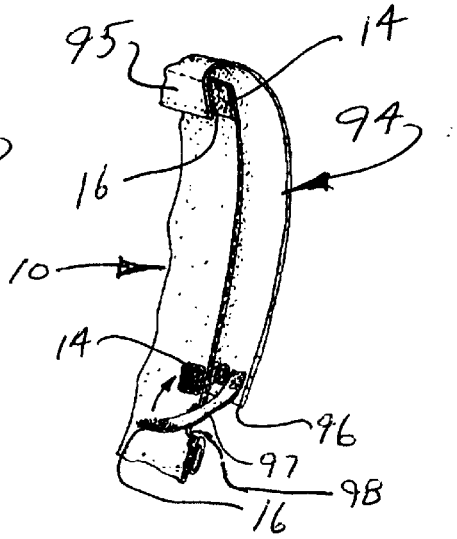
FIG. 28 is an isolated view, in partial section, taken along the line 28—28 of FIG. 26.

FIGS. 26–28 show a further embodiment of the present invention, wherein a fabric panel 94 is attachable to a man's or a woman's swimsuit 10. In the particular embodiment shown in FIGS. 26–27, the fabric panel 94 may be used for displaying a number to identify the participant in a race, such as a marathon or triathlon. The upper inner edge 95 of the fabric panel 94 is provided with a hook component 16 of the hook and loop fastening means 12 for releasable, mating attachment with the loop component 14 of the hook and loop fastening means found along the inner facing side of the waist band of the swimsuit 10. The lower edge 96 of the fabric panel 94 is provided with various means for further attaching the fabric panel to the swimsuit. Specifically, straps 97 extending from the bottom edge 96 include hook components 16 for releasable attachment to loop components 14 on the inner surface of the swimsuit 10, as seen in FIG. 28. To achieve this, an eyelet or hole 98 may be provided through the swimsuit, near the bottom edge, as seen in FIGS. 26–28, to accommodate passage of the strap 97 therethrough. Alternatively, the lower, inner edge of the fabric panel may be provided with a patch of hook component material 16 for releasable attachment with the mating loop component 14 provided on the outer surface of the swimsuit. Once secured, the fabric panel is maintained flat, against the wearer's body, as shown in FIG. 26, to display the number or other indicia thereon, without obstructing the fit of the swimsuit on the wearer.

Figure 29:
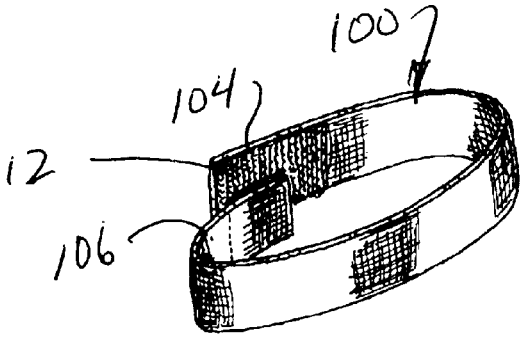
FIG. 29 is an isolated, perspective view showing the loop member in accordance with the embodiment of FIG. 25.
Figure 30:
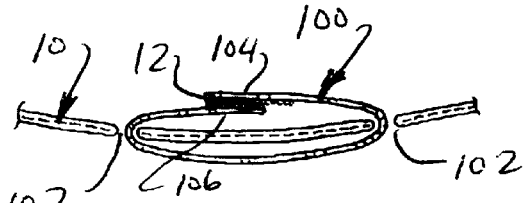
FIG. 30 is an isolated, cross sectional view taken along the line 30—30 of FIG. 25, showing the loop member secured to the swimsuit.
Figure 31:
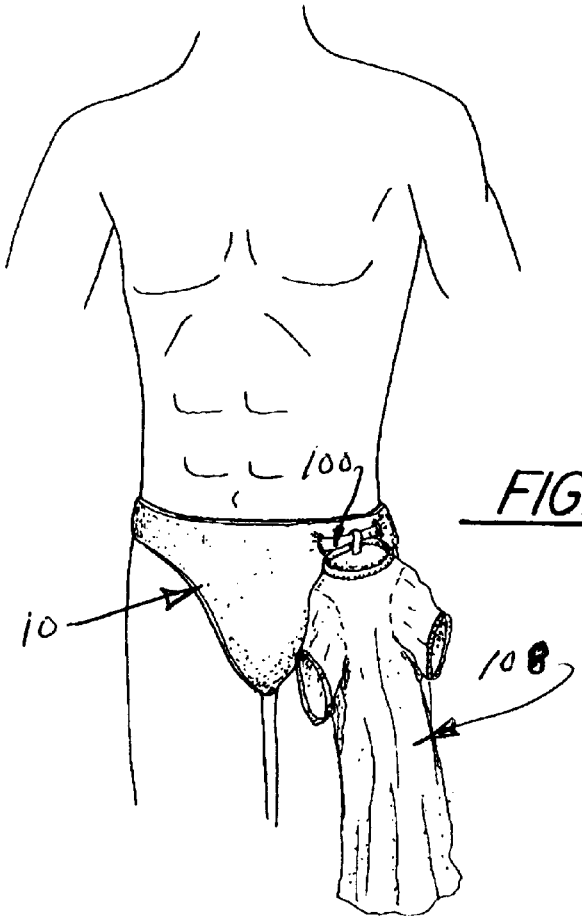
FIG. 31 is a front perspective view showing the loop member of the embodiment of FIG. 25 used for securing an article (e.g., a shirt) in hanging relation on the swimsuit.

In yet a further embodiment of the invention, a loop member 100 is provided for attachment through slotted openings 102 on the swimsuit, as seen in FIGS. 29–31. Specifically, the loop component 100 includes opposite free distal ends 104, 106 fitted with hook and loop fastening means 12 to secure the loop strap 100 in a closed loop. The opposite distal ends of the loop strap are fitted through the spaced openings on the swimsuit, as seen in FIGS. 30 and 31, and secured on either the inside or outside of the swimsuit, to form a closed loop. An article, such as a t-shirt 108, having a loop component may be further secured to the closed loop, to hang freely therefrom, as seen in FIG. 31. Alternatively, keys, sunglasses, baseball cap, or other articles may be secured to the loop member so that they are not lost. This is particularly useful for swimsuits which do not have pockets, thereby enabling the wearer to hold articles securely to the swimsuit.

While the instant invention has been shown and described in accordance with practical and preferred embodiments thereof, it is recognized that departures may be made within the spirit and scope of the present invention which, therefore, should not be limited except as set forth in the following claims as interpreted under the doctrine of equivalents.

What is claimed is:

1. A swimsuit comprising:

a plurality of loop members positioned and disposed on said swimsuit;

at least one elongate flexible member structured and disposed for releasable attachment t o one or more of said plurality of loop members; and means for releasably attaching one or more accessories to said swimsuit so that said one or more accessories are visibly arranged and positioned exteriorly of said swimsuit in a manner which alters the style and visual appearance of said swimsuit.

2. The swimsuit as recited in claim 1 comprising:

a woman's bikini swimsuit having a top with a pair of breast cups and a bottom; and said plurality of loop members including first and second loop members adjacent each of said cups of said swimsuit top.

3. The swimsuit as recited in claim 2 wherein said at least one elongate flexible member is removably attachable to either or both of said first and second loop members to support said swimsuit top on the wearer.

4. The swimsuit as recited in claim 3 wherein two elongate flexible members are each attachable to said first loop member adjacent said breast cups at one end thereof, and an opposite end of said two elongate flexible members being attachable to a back strap of said swimsuit top, to lift and separate the breasts of the wearer.

5. The swimsuit as recited in claim 2 wherein two elongate flexible members are each attachable to said first loop member adjacent to said breast cups at one end thereof, and an opposite end of each of said two elongate flexible members is attachable to a back strap of said swimsuit top, to lift and move the wearer's breast together.

6. The swimsuit as recited in claim 2 wherein two elongate flexible members are structured for releasable attachment to both of said first and second loop members adjacent each of said breast cups at one end thereof, and an opposite end of each of said two elongate flexible members is attachable to the back strap of the swimsuit top, to lift the breasts of the wearer.

7. The swimsuit as recited in claim 3 wherein said back straps of said swimsuit top include loop members on distal ends thereof, for releasable attachment of said at least one elongate flexible member thereto, to thereby secure said back straps together on the wearer's back, and further adjustably securing the swimsuit top about the wearer.

8. The swimsuit as recited in claim 1 wherein said means for attaching various accessories to the swimsuit includes hook and loop fastening means.

9. The swimsuit as recited in claim 2 wherein said means for attaching various accessories to the swimsuit includes hook and loop fastening means including a loop component material fitted along an inner lower edge of said swimsuit top and an inner upper edge of said swimsuit bottom.

10. The swimsuit as recited in claim 9 wherein said plurality of accessories each include a hook component material of said hook and loop fastening means for releasable attachment to said loop component material on said swimsuit top and bottom.

11. The swimsuit as recited in claim 10 wherein said plurality of accessories include a mid-panel sized and configured to cover the stomach of the wearer between said swimsuit top and bottom, said mid-panel including said hook component material along upper and lower edges thereof for releasable attachment with said loop component material on said swimsuit top and bottom, respectively.

12. The swimsuit as recited in claim 10 wherein said plurality of accessories include a gown having said hook component material thereon for releasable attachment to said loop component material on said swimsuit top, said gown being structured for releasable attachment to said swimsuit top so that said gown surrounds the wearer's body and hangs downwardly from a lower edge of said swimsuit top in covering relation about the wearer's body.

13. The swimsuit as recited in claim 10 wherein said plurality of accessories include a skirt having said hook component material thereon for releasable attachment to said loop component material on said swimsuit bottom, said skirt being structured and disposed for releasable attachment to said swimsuit bottom so as to extend downwardly from a waist band of said swimsuit bottom in surrounding relation to the wearer's legs.

14. The swimsuit as recited in claim 10 wherein said plurality of accessories include a strand of jewelry structured and disposed for releasable attachment to at least one of said plurality of loop components.

15. The swimsuit as recited in claim 1 further including an elastomeric band wrap having opposing edges fitted with hook and loop fastening means, said elastomeric band wrap being structured and disposed to be fitted about the swimsuit, at select locations, so that said opposing edges are secured to one another, in a manner which wraps said band wrap about said swimsuit.

16. The swimsuit as recited in claim 15 wherein at least one of said band wraps are fitted to said swimsuit top or bottom to enhance the appearance of said swimsuit.

17. The swimsuit as recited in claim 16 wherein said band wrap is releasably attached to said swimsuit to adjust the cut of said swimsuit on the wearer's body.

18. The swimsuit as recited in claim 1 wherein said at least one elongate flexible member includes a strip of fabric having a first distal end and an opposite second distal end, said first distal end including an elongate slot formed therein to facilitate passage of said second opposite distal end therethrough, to thereby form a loop to facilitate removable attachment of said fabric strip to one or more of said plurality of loop members.

19. The swimsuit as recited in claim 1 wherein said at least one elongate flexible member includes a linked chain comprising one or more ring members, wherein at least one of said ring members includes a clasp which is structured and disposed to open in order to facilitate removable attachment of said ring member to at least one of said plurality of loop members on said swimsuit.

20. A swimsuit comprising:

a woman's bikini swimsuit having a top with a pair of breast cups and a bottom;

a plurality of loop members positioned and disposed on said top and said bottom of said bikini swimsuit, said plurality of loop members including first and second loop members adjacent to each of said cups of said bikini swimsuit top;

a plurality of elongate flexible members being removably attachable to either or both of said first and second loop members to support said bikini swimsuit top on the wearer; and means for releasably attaching one or more accessories to said bikini swimsuit top and said bikini swimsuit bottom so that said one or more accessories are visibly arranged and positioned exteriorly of said swimsuit in a manner which alters the style and visual appearance of said swimsuit.

21. A swimsuit comprising:

a woman's bikini swimsuit having a top with a pair of breast cups and a bottom;

a plurality of loop members positioned and disposed on said top and said bottom of said bikini swimsuit, said plurality of loop members including first and second loop members adjacent to each of said cups of said bikini swimsuit top;

a plurality of elongate flexible members being removably attachable to said plurality of loop members to assist in fitting said swimsuit to the wearer;

means for releasably attaching one or more accessories to an exterior of said bikini swimsuit top and said bikini swimsuit bottom so that said one or more accessories are visibly arranged and positioned in a manner which alters the style and visual appearance of said swimsuit;

two of said plurality of elongate flexible members being attachable to said first loop member adjacent to said breast cups at one end thereof, and an opposite end of said two of said plurality of flexible members being attachable to a back strap of said bikini swimsuit top, to lift and separate the breasts of the wearer;

said two of said plurality of elongate flexible members being further attachable to said first loop member adjacent to said breast cups at one end thereof, and an opposite end of said two of said plurality of elongate flexible members being attachable to a back strap of said bikini swimsuit top, to thereby lift and move the wearer's breasts together;

said two of said plurality of elongate flexible members being further structured and disposed for releasable attachment to both of said first and second loop members adjacent to each of said breast cups at one end thereof, and an opposite end of each of said two of said plurality of elongate flexible members being attachable to the back strap of the bikini swimsuit top, to lift the breasts of the wearer;

said back straps of said bikini swimsuit top including loop members on distal ends thereof for releasable attachment of at least one of said plurality of elongate flexible members thereto, to thereby secure said back straps together on the wearer's back, and further providing a means for adjustably securing the bikini swimsuit top about the wearer;

said means for attaching various accessories to said bikini swimsuit top and said bikini swimsuit bottom including hook and loop fastening means, including a loop component material fitted along an inner lower edge of said bikini swimsuit top and a loop component material fitted along an inner upper edge of said bikini swimsuit bottom; and said plurality of accessories including a mid-panel sized and configured to cover the stomach of the wearer between said bikini swimsuit top and said bikini swimsuit bottom, said mid-panel including a hook component material along upper and lower edges thereof for releasable attachment with said loop component material on said bikini swimsuit top and said bikini swimsuit bottom, respectively.

22. The swimsuit as recited in claim 21 wherein said plurality of accessories include a gown having said hook component material thereon for releasable attachment to said loop component material on said bikini swimsuit top, said gown being structured for releasable attachment to said bikini swimsuit top so that said gown surrounds the wearer's body and hangs downwardly from a lower edge of said bikini swimsuit top in covering relation about the wearer's body.

23. The swimsuit as recited in claim 21 wherein said plurality of accessories include a skirt having said hook component material thereon for releasable attachment to said loop component material on said bikini swimsuit bottom, said skirt being structured and disposed for releasable attachment to said bikini swimsuit bottom so as to extend downwardly from a waist band of said swimsuit bottom in surrounding relation to the wearer's legs.

24. The swimsuit as recited in claim 21 wherein said plurality of accessories include a strand of jewelry structured and disposed for releasable attachment to at least one of said plurality of loop components.

25. The swimsuit as recited in claim 20 further including an elastomeric band wrap having opposing edges fitted with hook and loop fastening means, said elastomeric b and wrap b being structured and disposed t o be fitted about the swimsuit, at select locations, so that said opposing edges are secured to one another, in a manner which wraps said band wrap about said swimsuit.

26. The swimsuit as recited in claim 25 wherein at least one of said band warps are fitted to said bikini swimsuit top or bottom to enhance the appearance of said swimsuit.

27. The swimsuit as recited in claim 26 wherein said band wrap is releasably attached to said swimsuit to adjust the cut of said swimsuit on the wearer's body.

28. The swimsuit as recited in claim 20 wherein said plurality of elongate flexible members are each defined by a strip of fabric having a first distal end and an opposite second distal end, said first distal end including an elongate slot formed therein to facilitate passage of said second opposite distal end therethrough, to thereby form a loop to facilitate removable attachment of said fabric strip to one or more of said plurality of loop members.

29. The swimsuit as recited in claim 20 wherein said plurality of elongate flexible members include a linked chain comprising one or more ring members, wherein at least one of said ring members includes a clasp which is structured and disposed to open in order to facilitate removable attachment of said ring member to at least one of said plurality of loop members on said swimsuit.

* * * * *